US005248031A

United States Patent [19]

Burrows et al.

[11] Patent Number: 5,248,031

[45] Date of Patent: * Sep. 28, 1993

[54] CIGARETTE PACKAGE

[75] Inventors: Diane S. Burrows; Larry D. Cobler, both of Winston-Salem, N.C.

[73] Assignee: R. J. Reynolds Tobacco Company, Winston-Salem, N.C.

[ * ] Notice: The portion of the term of this patent subsequent to Aug. 18, 2009 has been disclaimed.

[21] Appl. No.: 930,962

[22] Filed: Aug. 14, 1992

Related U.S. Application Data

[63] Continuation of Ser. No. 717,456, Jun. 19, 1991, Pat. No. 5,139,140.

[51] Int. Cl.[5] ..... B65D 85/10

[52] U.S. Cl. ..... 206/268; 206/273

[58] Field of Search ..... 206/242, 265, 268, 271, 206/273; 229/160.1

[56] References Cited

U.S. PATENT DOCUMENTS

| | | |
|---|---|---|
| 356,244 | 1/1887 | Emery . |
| 1,306,574 | 6/1919 | Boerlin . |
| 1,440,270 | 12/1922 | Bertherman . |
| 1,725,869 | 8/1929 | Kornsweet . |
| 1,742,657 | 1/1930 | Littell . |
| 1,897,702 | 2/1933 | Lewnes . |
| 1,967,204 | 7/1934 | Genz . |
| 2,107,826 | 2/1938 | Keller . |
| 2,219,179 | 10/1940 | Fayer et al. . |
| 2,265,828 | 12/1941 | Wilson . |
| 2,353,761 | 7/1944 | Ringler . |
| 2,704,182 | 3/1955 | Sandler . |
| 2,825,343 | 3/1958 | Richner . |
| 2,901,097 | 8/1959 | Tamarin . |
| 2,902,201 | 9/1959 | Engblom . |
| 2,956,722 | 10/1960 | Prussack . |
| 2,960,264 | 11/1960 | Walter . |
| 2,983,424 | 5/1961 | Glass . |
| 2,997,221 | 8/1961 | Gimple . |
| 3,037,683 | 6/1962 | Sherrill . |
| 3,039,671 | 6/1962 | Chiamardas . |
| 3,052,398 | 9/1962 | Benjamin . |
| 3,078,029 | 2/1963 | Lacey . |
| 3,207,416 | 9/1965 | Koltz et al. . |
| 3,282,456 | 11/1966 | Davis . |
| 3,533,550 | 10/1970 | Benzon-Peterson . |
| 3,765,593 | 10/1973 | D'Alessio . |
| 3,823,865 | 7/1974 | Mechnick . |
| 4,172,520 | 10/1979 | Gero . |
| 4,240,548 | 12/1980 | Stio . |
| 4,294,399 | 10/1981 | Wifer . |
| 4,372,443 | 2/1983 | Woo Seop . |
| 4,375,260 | 3/1983 | Focke et al. . |
| 4,513,863 | 4/1985 | Schillinger . |
| 4,913,292 | 4/1990 | Field . |
| 4,961,496 | 10/1990 | Focke et al. . |
| 5,014,906 | 5/1991 | Gero . |
| 5,139,140 | 8/1992 | Burrows et al. ..... 206/268 |

*Primary Examiner*—Bryon P. Gehman

[57] ABSTRACT

A hinged lid cigarette package can have cigarettes removed therefrom as is common for a hinged lid package or as is common for a soft package. The hinged lid package includes a top panel having a stationary portion and a removable portion. Removal of the removable portion exposes a movable flap which can be opened and closed to allow removal of cigarettes from the package and closure of the package.

8 Claims, 7 Drawing Sheets

CIGARETTE PACKAGE

CROSS REFERENCE TO RELATED APPLICATION

This is a continuation of co-pending application Ser. No. 07/717,456, filed Jun. 19, 1991, now U.S. Pat. No. 5,139,140.

BACKGROUND OF THE INVENTION

The present invention relates to a package for smoking articles such as cigarettes, and in particular to a cigarette package of the hinged lid type.

Popular smoking articles such as cigarettes conventionally have been sold in packages. Typically, each package contains about 20 cigarettes.

One type of popular cigarette package is the so-called "hard-pack," "crush proof box" or "hinged lid package." Such a package has a generally cuboid-type shape, is manufactured from resilient paperboard, and includes an outer wrap of transparent polypropylene film. Hinged lid cigarette packages conventionally are made from two paperboard blanks. One blank forms the body and lid of the package. The second blank forms an insert or inner frame which is assembled to the inside of the front and side walls of the package. The inner frame projects above the front and side walls of the package body, and provides a seal between the lid and body when the package is closed. See, for example, U.S. Pat. No. 4,852,734 to Allen, et al., which is incorporated herein by reference. Other types of designs of blanks for hinged lid cigarette packages can be of the type described in U.S. Pat. Nos. 3,874,581 to Fox, et al., and 3,944,066 to Niepmann.

Cigarettes also can be packaged in a container having the form of a so-called "soft pack." See, for example, U.S. Pat. Nos. 3,695,422 to Tripodi and 4,717,017 to Sprinkel, Jr., et al. Cigarettes are removed from a soft package by tearing away a portion of the top of the package, in order that cigarettes can be easily accessed from the top of the package.

It would be highly desirable to provide a hinged lid type cigarette package which can have cigarettes removed therefrom in a variety of ways.

SUMMARY OF THE INVENTION

The present invention relates to a hinged lid package for smoking articles such as cigarettes. The package includes a body portion and a lid portion which is integrally hinged to the body portion. The body portion includes a front wall, a bottom wall, a rear wall, inner side walls and outer side walls. The lid portion includes a front wall, a top wall, a rear wall integrally hinged to the rear wall of the body portion, inner side walls and outer side walls.

The top wall of the package includes a (i) removable panel or portion, and (ii) a stationary portion which remains with the package during the useful lifetime of the package. The package also includes a movable top flap positioned between the removable top panel and the cigarettes within the package. The top flap is positioned such that it can be opened to allow removal of cigarettes from the package, and then closed. As such, the package can be employed as a conventional hinged lid package, or in a manner similar to a soft package (i.e., so as to gain access to the cigarettes through the top of the package).

The packages of the present invention are manufactured from suitable blanks (e.g., paperboard blanks) in much the same manner as are conventional hinged lid cigarette packages, filled with cigarettes using conventional cigarette packaging technology, and overwrapped with outer wrap as is conventional in the cigarette packaging art.

The package of the present invention includes the desirable features of the popular hinged lid package design. That is, the package, once initially opened, is fully recloseable after each successive cigarette is removed therefrom so as to (i) protect cigarettes contained therein, and (ii) minimize the loss or spillage of particles of tobacco cut filler from the opened package. In addition, the package of the present invention includes the desirable features of a soft package. That is, the package once initially opened can be employed in a manner that each successive cigarette can be easily accessed and removed from the package without opening the entire hinged lid portion.

DETAILED DESCRIPTION OF THE PREFERRED EMBODIMENTS

Figure 1:
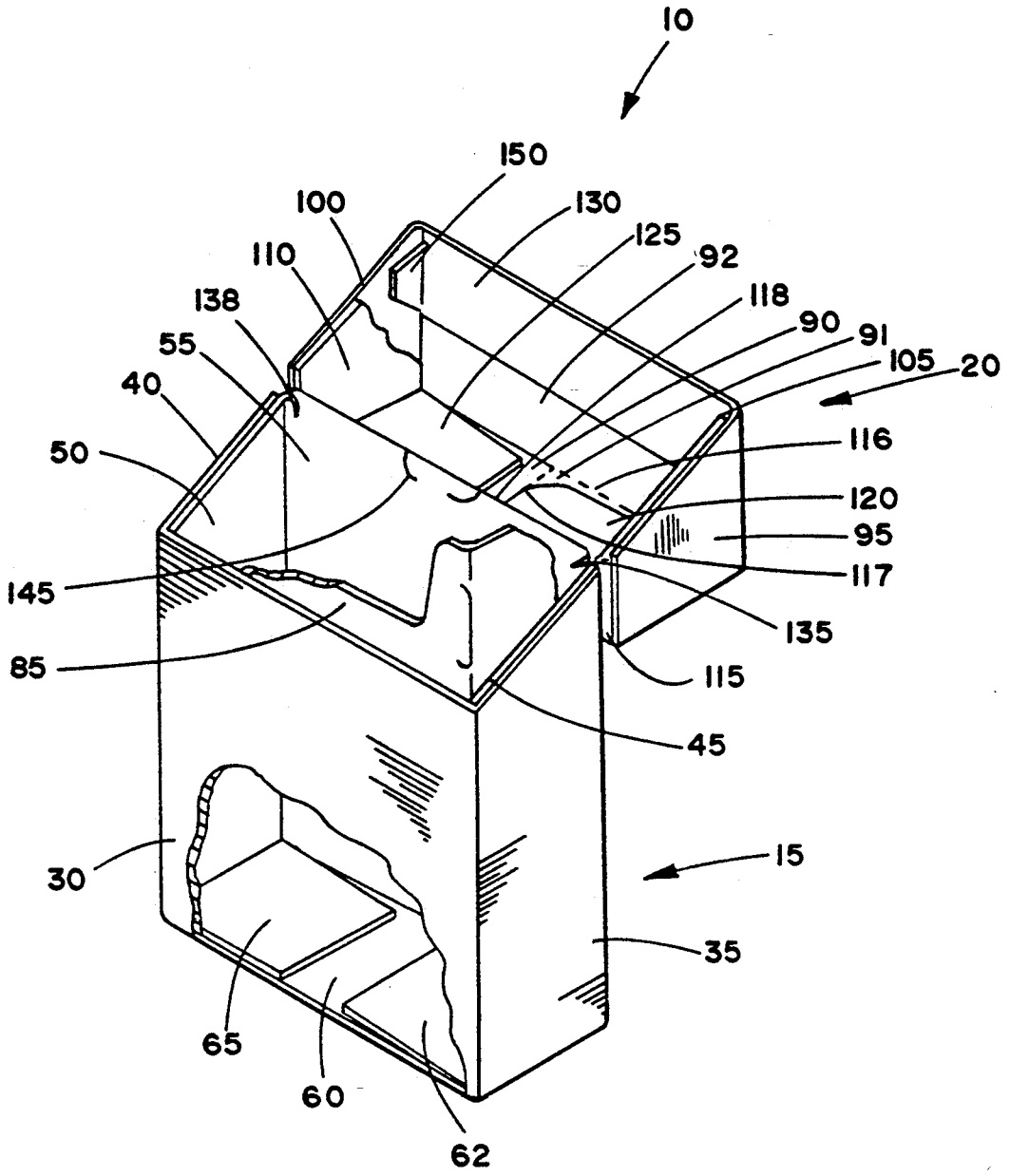
FIG. 1 is a perspective of a representative assembled hinged lid package of the invention in one type of open position.

Referring to FIG. 1, assembled hinged lid package of cigarette box 10 includes a body portion 15 and a lid portion 20. The package has a generally rectilinear shape when viewed from the bottom thereof.

The body portion includes a front wall 30 (shown as partially cut away), outer side walls 35 and 40, inner side walls 45 and 50, rear wall 55, bottom wall 60, and bottom flaps 62 and 65. The upper edges of the inner and outer side walls of the body of the package can extend from the front of the package to the back thereof at an upward incline of about 30 degrees, or any other desired angle. Generally, the inner and outer side walls of each side of the body are of similar shape and dimension. An inner liner or collar 85 (shown as partially cut away) is glued or otherwise secured to the inner surface of a portion of the front wall 30 and the inner side wall 45 and 50. Packages having integral inner liners can be employed, if desired.

The lid portion 20 includes a stationary top wall portion 90, removable top wall portion or panel 91, front wall 92, outer side walls 95 and 100, inner side wall 105 and inner side wall 110 (shown as partially cut away), and rear wall 115 which is integrally hinged to rear wall 55 of the body 15. The lower edges of the inner and outer side walls of the lid of the package can extend from the front of the package to the back thereof at an upward incline of about 30 degrees, or any other desired angle. Generally, the inner and outer side walls of each side of the lid are of similar shape and dimension. The removable top wall or panel 91 is removed (as described in greater detail hereinafter) by tearing that panel along perforation lines 116 and 117.

Hinge 118 has the form of a crease, fold or score line across the rear wall of the box. The lid portion also includes top flaps 120 and 125, and reinforcing panel 130. Top flap 120 is a movable flap which can be moved so as to open and close the box, as described in greater detail hereinafter. The movable top flap 120 is attached to the remaining package through lid inner side wall 105, and top flap 120 is movable about a creased line along the top flap and the inner side wall. As such, the top flap 120 is movable about a hinge formed by the crease separating the top flap from the outer side wall. The box 10 also can include optional tear minimizers 135 and 138, and stress reliever 145 in the region of hinge 118; as is common in conventional hinged lid package manufacture.

Tab 150 is integrally connected to one side of the lid reinforcing panel 130, and extends between lid outer side wall 100 and lid inner side wall 110 (shown as cut away). In particular, a fold between the reinforcing panel and the tab 150 allows the tab to fit between the two side wall portions. A similar tab (not shown) is connected to the opposite side of the lid reinforcing panel, and is fit between lid outer side wall 95 and lid inner side wall 105. See, also U.S. Pat. No. 4,852,734 to Allen, et al.

The hinged lid or crush proof package conveniently is secured together by applying adhesive material to the outer surfaces of inner walls 45, 50, 105 and 110. Application of adhesive to the inner surface of the lid reinforcing panel is optional when tabs integrally connected to the lid reinforcing panel are present. Adhesives used in the construction of the package will be apparent to the skilled artisan. The package can include printed indicia indicating brand identification and directions for using the package.

Figure 2:
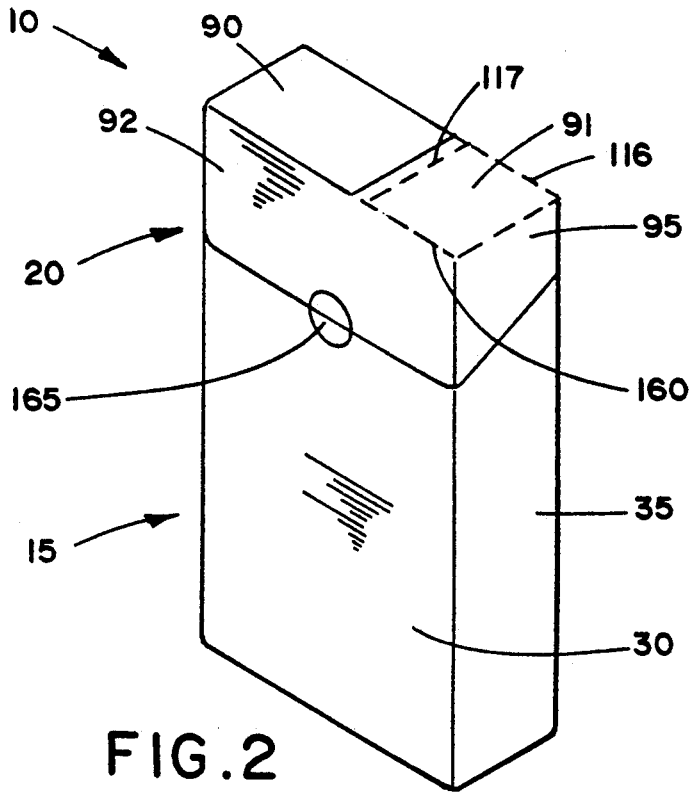
FIG. 2 is a perspective of a representative assembled hinged lid package of the invention in a closed position.

Referring to FIG. 2, package 10 includes a stationary top wall 90, and a top panel 91 which is removable therefrom. The package includes only 2 essentially rectangular shaped top wall portions or panels, and each portion is positioned at opposite sides of the package separated by perforation line 117. The removable top panel 91 is removed by tearing that panel from the package along perforation lines 116, 117 and 160. The perforation lines are between the removable top panel and (i) the lid front wall, (ii) the stationary panel, and (iii) the lid rear wall. As such, the top flap 120 is exposed and stationary top wall portion 90 remains with the package when the removable top panel is torn away. In addition, adhesive seal 165 positioned between the front lid and body walls can act to maintain the lid in a closed position, but be easily broken to allow the package to be opened by moving the lid about the hinge 118 between the lid and body portions.

Figure 3:
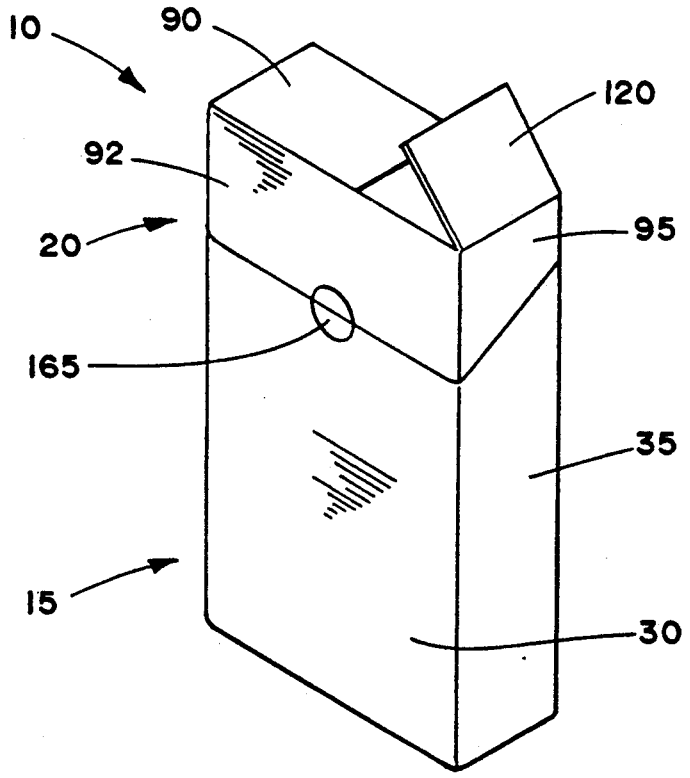
FIG. 3 is a perspective of a representative assembled package of the invention in another type of open position.

As shown in FIG. 3, the recloseable top flap 120, which is exposed after top panel 91 is removed and discarded, can be opened to expose inner wrapping material and cigarettes within the package. The package can be opened by the smoker by flipping the flap out with his/her fingers or by squeezing the top sides of the package. The top flap 120 then can be closed such that a portion of the top flap fits underneath stationary top wall portion 90. As such, the package can be opened either as a conventional hinged lid package, or using the recloseable top flap.

Figure 4:
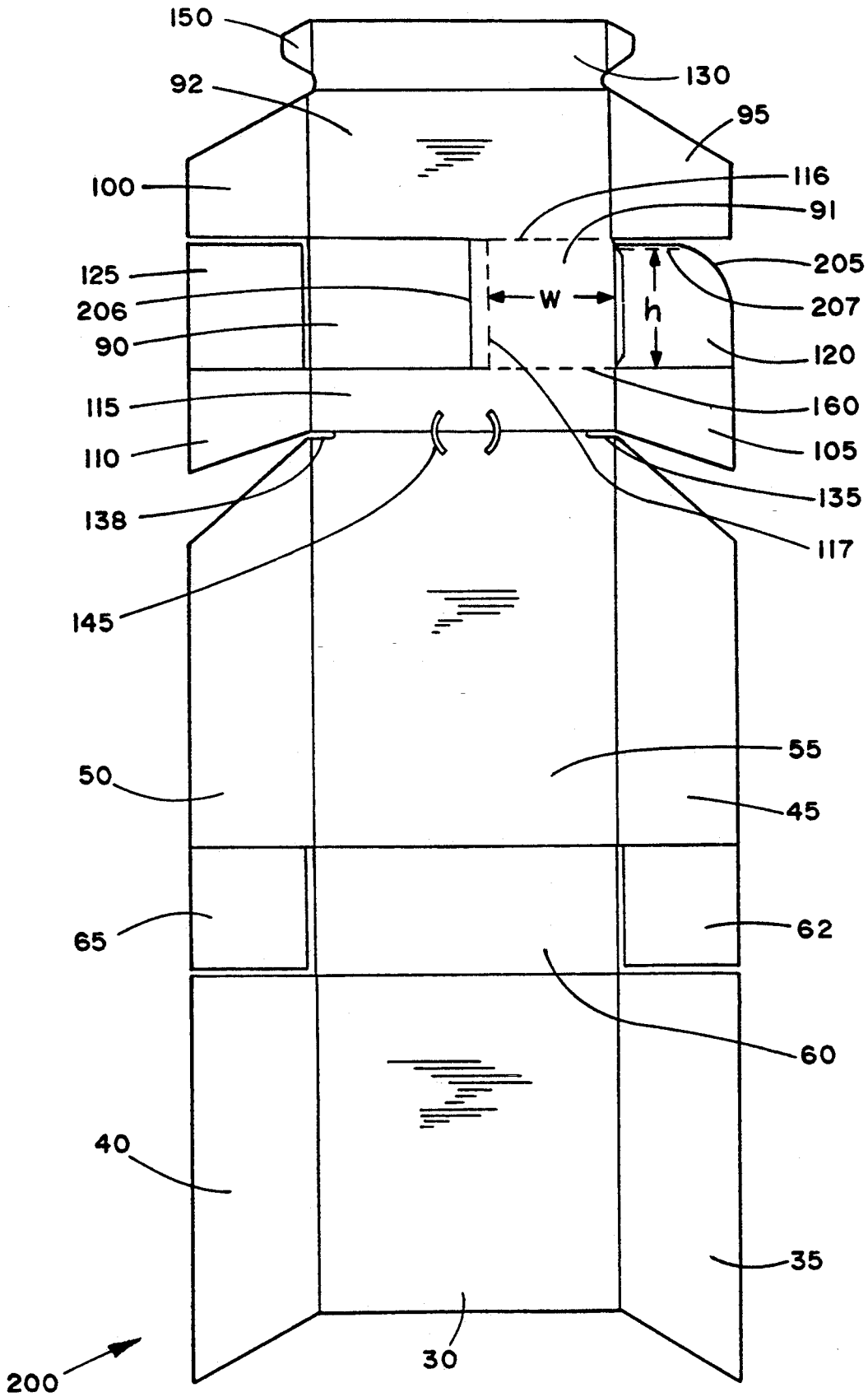
FIGS. 4 through 8 are diagrammatic schematic, approximate scale illustrations of blanks for the manufacture of the body and lid portions cigarette packages of the present invention.

The body and lid of the packages shown in FIGS. 1 through 3 conveniently are provided using known techniques and equipment from blank 200 which is shown in FIG. 4. The blank 200 most preferably is provided from a paperboard sheet, and includes a plurality of fold lines, creases or score lines (shown as solid lines in FIG. 4); perforations (shown as dotted lines in FIG. 4); and a plurality of cuts. The degree of perforation can vary, and can be provided as to provide for the desired ease of removal of the top panel during use of the package. However, the selection of perforation degree or pattern is such that the removable top panel does not easily tear from the package if the smoker desires to not remove the top panel and employ the package as a hinged lid package; but also is such that the top panel can be readily and conveniently removed by the smoker if he/she so desires. The cuts conveniently are made by slitting the blank without removal of material therefrom; however, for illustration purposes, the slit lines are shown in FIG. 4 as narrow slots. The folds, perforations and cuts define panels which correspond to the walls and flaps of the package which is constructed from the blank. The folds, perforations and cuts are provided using techniques readily apparent to the skilled artisan. The top flap 120 includes an outwardly curved edge 205 towards its outermost edge opposite outer side wall 95. Such a curved edge is provided by cutting away a portion of the top flap 120. The cut away portion provides for a region for the smoker to grasp the top flap with his/her finger when the blank is assembled as a package in order to more easily open the recloseable flap. Typically, the height H of the top flap 120 is slightly greater (e.g., by about 0.5 to about 3 mm, preferably by about 1 to about 2 mm) than the width W of the removable top panel 91. As such, a portion of the top flap can be positioned under stationary top wall portion 90 of an assembled package in order that the top flap can remain in a closed position until opened by the smoker. In addition, the cut between top flap 120 and removable top panel 91 is such that the removable top panel is extended slightly towards the top flap, and the top flap is recessed slightly relative to the top panel. Crease 206 extending across stationary top panel 90 essentially parallel to perforation line 117, and perforation line or score line 207 in top flap 120 acts to provide flexibility to those regions of the assembled package in order that the top flap can be readily opened and closed numerous times.

Figure 5:
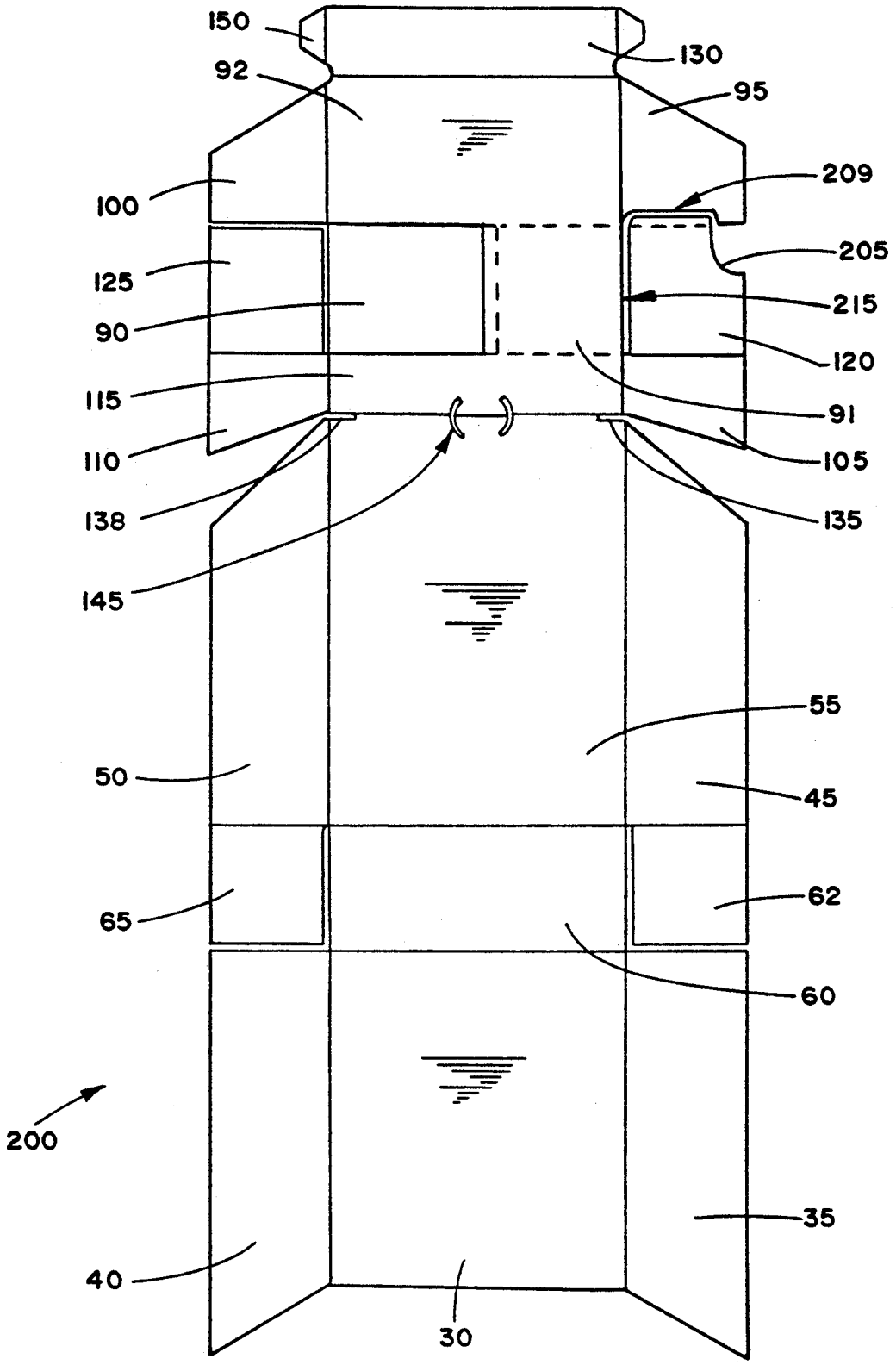

Referring to FIG. 5, blank 200 is similar in manner respects to that blank described with reference to FIG. 4. However, a notch 209 is formed in the region of outer side wall 95 opposite top flap 120 by cutting the blank so that the outer side wall is recessed relative to the top flap. As such, when a package is assembled from the blank, the removable top panel 91 extends slightly over the resulting notch in the outer side wall 95 in order that edge 215 of the top panel can be grasped easily by the smoker and hence removed from the remainder of the assembled package. In addition, the top flap can include an inwardly curved edge 205 towards the outermost edge opposite outer side wall 95. In addition, the cut between top flap 120 and removable top panel 91 is such that the top flap is not recessed relative to the top panel.

Figure 6:
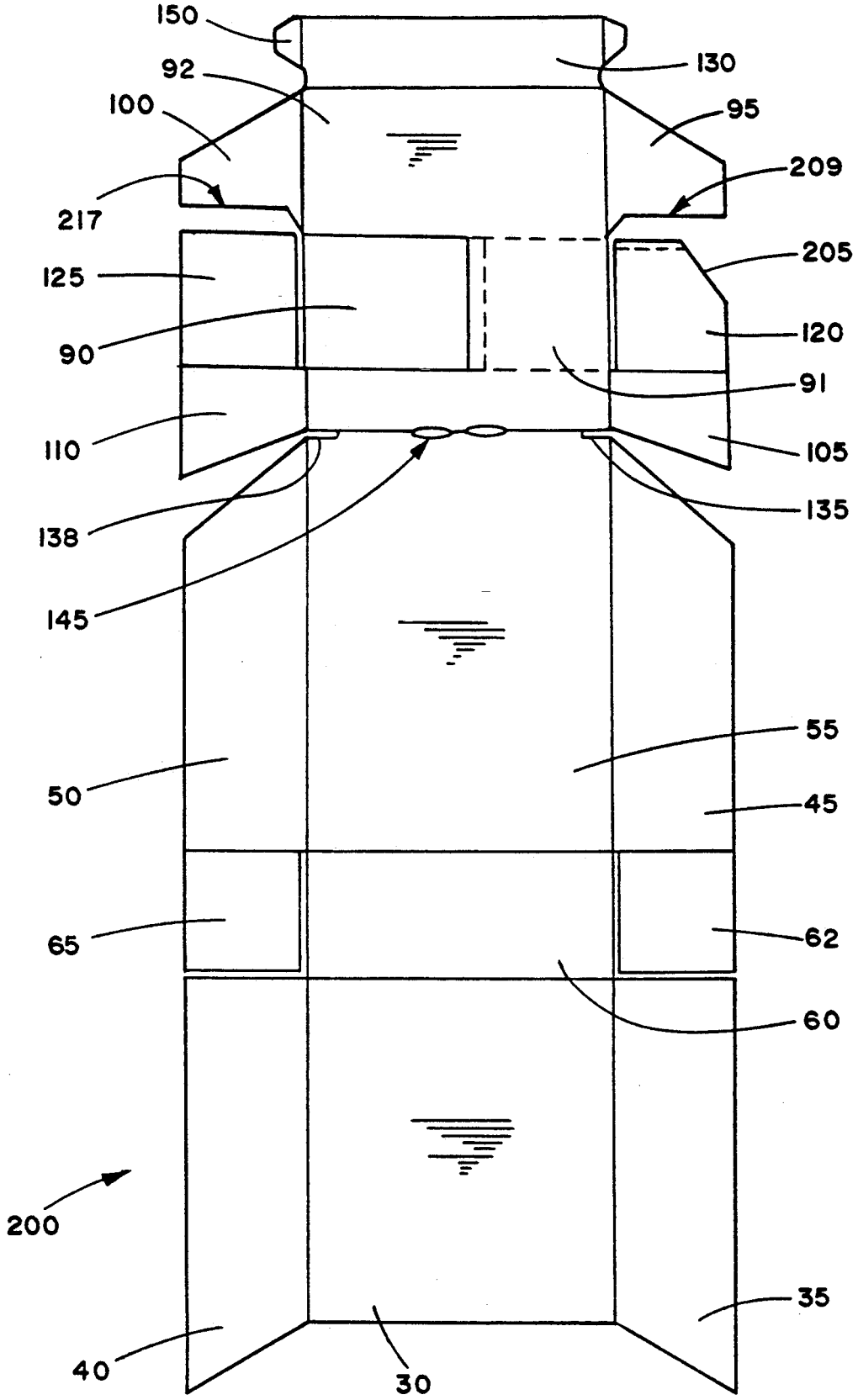

Referring to FIG. 6, blank 200 is similar in many respects to that blank described with reference to FIG. 5. However, notch 209 is formed in the region of outer side wall 95 opposite top flap 120 by cutting away a portion of the outer side wall. Optionally, a similar and symmetrical notch 217 can be provided in outerside wall 100 by cutting away a portion of that wall. Such optional notch 217 provides for an assembled package having a more symmetrical appearance.

Figure 7:
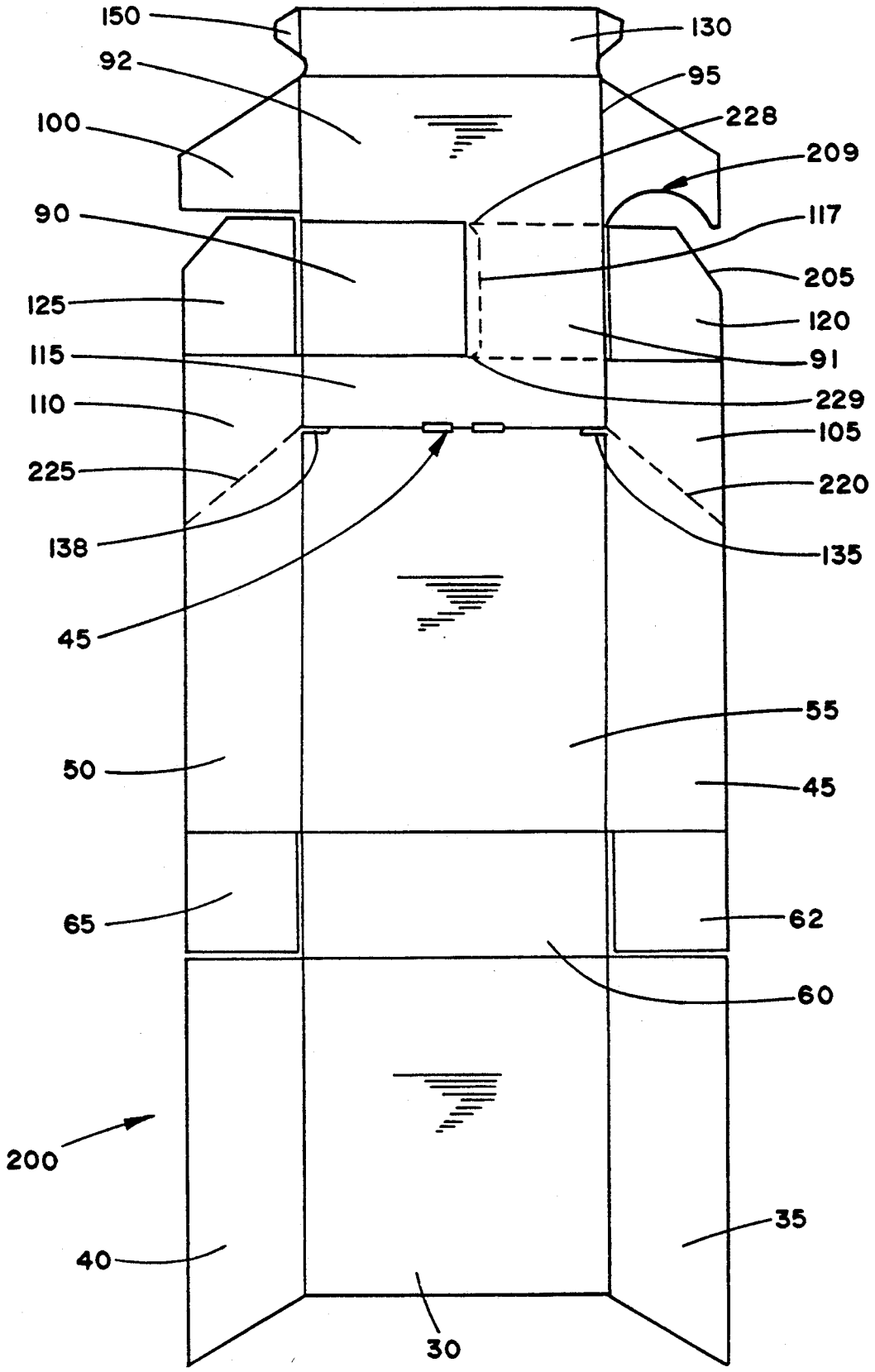

Referring to FIG. 7, blank 200 is similar in many respects to the blank described with reference to FIG. 6. However, the notch 209 in the outer side wall 95 has a curved shape so as to curve inwardly into outer side wall. In addition, lid inner side walls 105, 110 extend to meet the body side walls 45, 50, respectively. The inner side walls of the lid and body portions are separated by a line of perforations 220, 225. The line of perforations can be a line of a plurality of tiny cuts and nicks, or large cuts with a few small nicks. As such, when such blank is assembled into a package, the lid is held securely to the body portion if the top panel 91 is removed and cigarettes are removed from the top of the package; while the perforations can be broken easily by the smoker when opening the package in the manner characteristic of a conventional hinged lid package. In addition, the corners 228, 229 of stationary top wall portion 90 are radiused inwards at a slight curve along perforation line 117. Such curvature of the corners of the stationary top wall provide a flexibility so that top flap 120 can be easily opened and closed during use of the assembled package.

The blanks described with reference to FIGS. 4 through 7 can be readily assembled into packages containing cigarettes using a cigarette packaging machine available as GDX2 from G.D. S.P.A.

Figure 8:
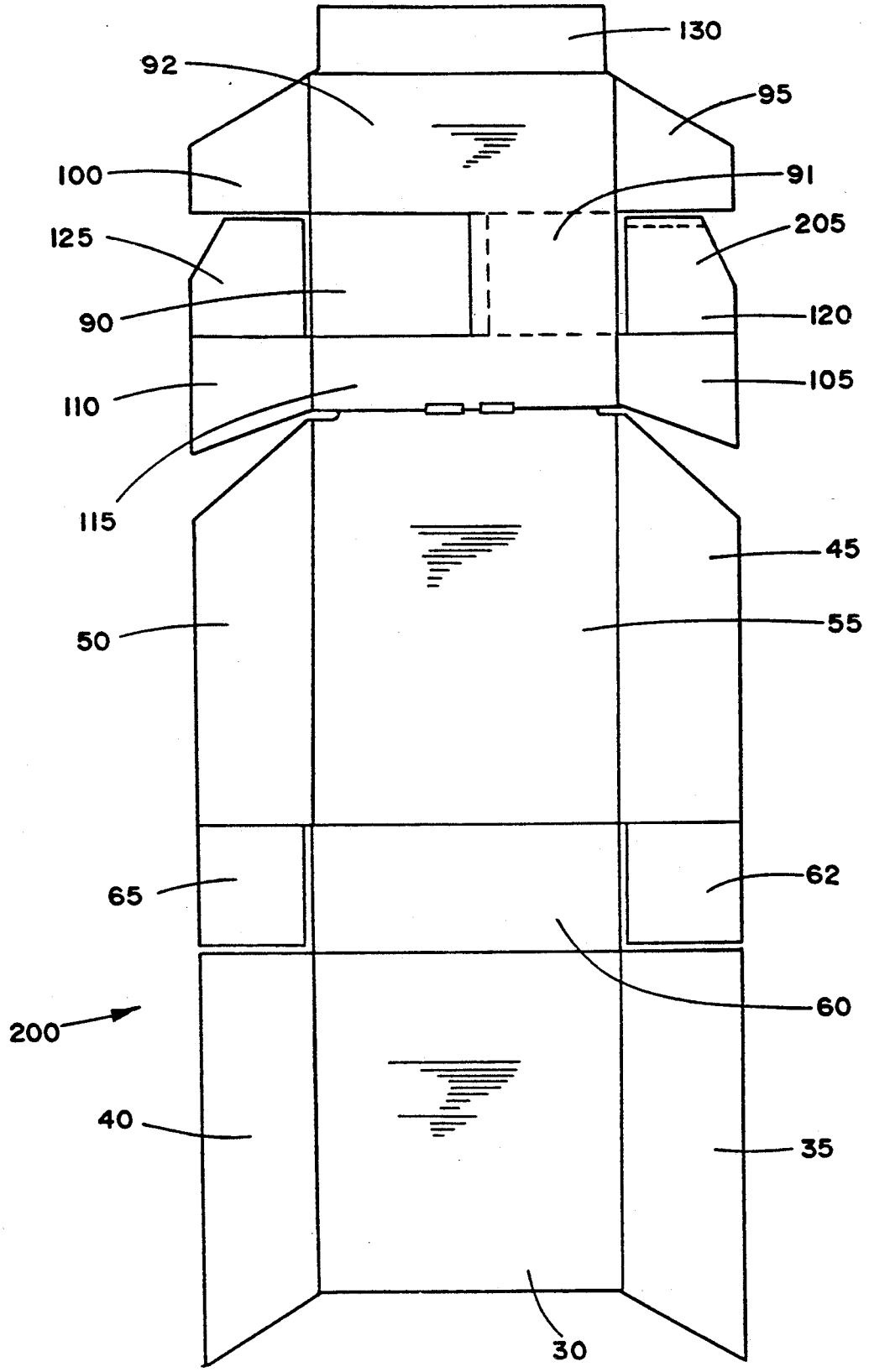

Referring to FIG. 8, blank 200 is similar in many respects to that blank described with reference to FIGS. 4 through 7. However, the lid reinforcing panel 130 is slightly different in shape to that panel shown in FIGS. 4 through 7. In addition, the top flap can include straight edge 205 running diagonally from its outer most edge opposite outer side wall 95.

The blank described with reference to FIG. 8 can be assembled into a package containing cigarettes using cigarette packaging machines available as GDX2 from G.D. S.P.A. and 350 S from Focke & Co.

Each blank can be assembled into a cigarette package containing cigarettes using techniques and equipment known to the skilled artisan. Typically, 20 cigarettes are contained within each package (e.g., in a 7-6-7 or 7-7-6 configuration), along with conventional package insert materials (e.g., paper/foil laminate inner packaging material) in a manner readily apparent to the skilled artisan. Normally, the cigarettes are packaged such that the filter end or mouthend of each cigarette essentially abuts the inner portion of the top of the package; however, the cigarettes also can be packaged such that the lighting end or tobacco end of each cigarette essentially abuts the inner portion of the top of the package and the filter end is positioned in the bottom of the package. If desired, the inner paper/foil laminate material which covers the cigarettes within the package can be perforated or otherwise provided so as to be torn away easily, particularly when the package is opened by tearing away the removable top panel and opening the top flap.

Each package then is overwrapped using an outer wrapping material, such as cellophane, polypropylene film, the metallized material described in U.S. patent application Ser. No. 525,737, filed May 17, 1990; or the overwrapping materials described in U.S. Pat. Nos. 4,807,745 to Langley, et al.; or 4,947,994 to Newsome. See also, U.S. patent application Ser. No. 696,700, filed May 7, 1991. The overwrapping material for each package preferably includes a tear tape, which is provided using known techniques. The tear tape can be positioned so as to circumscribe the package (i) in the region just below or near the bottom of the hinged lid (as is common for conventionally wrapped hinged lid packages; (ii) around the center region of the lid portion; or (iii) near the extreme top of the package (as is common for conventionally wrapped soft packages).

An example of a representative embodiment of the invention is an assembled hinged lid package having a height of about 85 mm, a width of about 55 mm and a depth of about 23 mm. The package is manufactured from resilient, durable paperboard (e.g., a low density solid bleached sulfate paperboard) having a thickness of 0.012 inch and a paperboard inner liner so as to have the configuration shown in FIGS. 1 through 3. The body and lid of the package is manufactured from the blank shown in FIG. 4. The removable panel has dimensions of about 23 mm by about 24 mm. The top flap has dimensions of 23 mm by about 20.5 mm. When the blank is assembled into a package, the top flap extends under the top wall about 1.5 mm so that the flap can maintain a closed relationship, but easily be clicked open to expose the cigarettes in the package.

In a less preferred embodiment (not shown), perforation lines can extend only between the removable top panel and (i) the stationary top panel, and (ii) the lid rear wall; and a cut is provided between the removable top panel and the lid front wall; in order that the removable top panel can be removed by grasping that panel from the front of the package.

In a much less preferred embodiment (not shown), perforation lines can extend only between the removable top panel and (i) the stationary top panel and (ii) the lid front panel; and a cut is provided between the removable top panel and the lid rear wall; in order that the removable top panel can be removed by grasping that panel from the back of the package.

What is claimed is:

1. An assembled hinged lid cigarette package containing cigarettes, (A) the package including:

(a) a body portion including a front wall, a bottom wall, a rear wall, inner side walls and outer side walls; and (b) a lid portion including a rear wall integrally hinged to the rear wall of the body portion about a hinge, a front wall, a top wall, inner side walls and outer side walls; the top wall having a stationary top portion and a removable top portion;

(B) the package being capable of being opened to have cigarettes removed therefrom and then closed;

(C) the package being capable of being opened by either (a) opening the lid portion about the hinge between the lid portion and the body portion to expose cigarettes within the package, or (b) removing the removable portion from the top wall to expose a movable top flap which underlies the removable portion, and while the lid portion of the package is in a closed position relative to the body portion of the package, moving the top flap to expose cigarettes within the package.

2. The package of claim 1 wherein a portion of the movable flap fits underneath the stationary top portion.

3. The package of claim 1 containing twenty cigarettes.

4. The package of claim 1 including a line of perforation between the removable top portion and the stationary top portion.

5. The package of claim 1 wherein the movable flap includes a cut away portion to provide a region for grasping the movable flap when the flap is in a closed position.

6. The package of claim 1 wherein the removable top portion extends over a notch formed in one outer side wall of the lid portion.

7. The package of claim 1 including a substantially rectangular-shaped stationary top portion and a substantially rectangular-shaped removable top portion, each top portion positioned at opposite sides of the package and separated by a perforation line; the removable top portion being removable by tearing that portion along perforation lines between the removable portion and (i) the front wall of the lid portion, (ii) the stationary top portion, and (iii) the rear wall of the lid portion.

8. The package of claim 1 wherein the removable top portion is removed from the package by tearing that portion from the package so that the stationary top portion remains with the package.

* * * * *